US008847999B2

(12) United States Patent
Toyomura et al.

(10) Patent No.: US 8,847,999 B2
(45) Date of Patent: Sep. 30, 2014

(54) DISPLAY DEVICE, METHOD FOR DRIVING THE SAME, AND ELECTRONIC UNIT

(75) Inventors: Naobumi Toyomura, Kanagawa (JP); Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 934 days.

(21) Appl. No.: 12/923,764

(22) Filed: Oct. 7, 2010

(65) Prior Publication Data

US 2011/0109664 A1 May 12, 2011

(30) Foreign Application Priority Data

Nov. 11, 2009 (JP) ..... 2009-258314

(51) Int. Cl.
*G09G 5/10* (2006.01)
*G09G 3/32* (2006.01)

(52) U.S. Cl.
CPC ..... *G09G 3/3225* (2013.01); *G09G 2310/0251* (2013.01); *G09G 2340/16* (2013.01); *G09G 2320/045* (2013.01)
USPC ..... 345/690

(58) Field of Classification Search
CPC ..... G09G 2320/0271; G09G 2320/045
USPC ..... 345/690
See application file for complete search history.

(56) References Cited

U.S. PATENT DOCUMENTS

2008/0030436 A1 2/2008 Iida et al.
2009/0073095 A1* 3/2009 Uchino et al. ..... 345/77

FOREIGN PATENT DOCUMENTS

JP 2007-108381 A 4/2007
JP 2008-033193 A 2/2008
JP 2008-191296 A 8/2008
JP 2008-256916 A 10/2008
JP 2009-069552 A 4/2009
JP 2009-157018 A 7/2009
JP 2010-211108 A 9/2010
JP 2011-100038 A 5/2011
JP 2011-102929 A 5/2011
JP 2011-102930 A 5/2011

OTHER PUBLICATIONS

Japanese Office Action issued May 2, 2013 for corresponding Japanese Application No. 2009-258314.

* cited by examiner

*Primary Examiner* — Amr Awad
*Assistant Examiner* — Randal Willis
(74) *Attorney, Agent, or Firm* — Rader, Fishman & Grauer PLLC

(57) ABSTRACT

A display device includes: a display section including a plurality of pixels each having a light emitting element and a pixel circuit; and a drive circuit performing display drive on the plurality of pixels through selecting each of the plurality of pixels to write a first signal voltage and a second signal voltage in this order into the selected pixel, the first and second signal voltages being provided based on a video signal. The drive circuit varies magnitude of each of the first and second signal voltages in accordance with a gray-scale value of the video signal, thereby performing gray-scale interpolation on a light emission luminance level for each of the light emitting elements.

12 Claims, 12 Drawing Sheets

710
720
740

710
730
720

710
730
770
750
760

720
710

710
720

710
720

DISPLAY DEVICE, METHOD FOR DRIVING THE SAME, AND ELECTRONIC UNIT

BACKGROUND OF THE INVENTION

1. Field of the Invention

The present invention relates to a display device for displaying an image by light emitting elements disposed in pixels, a method of driving the same, and an electronic unit having such a display device.

2. Description of the Related Art

In recent years, in the field of a display device for displaying an image, a display device (organic EL (Electro Luminance) display device) using, as a light emitting element, an optical element of a current driving type whose light emission luminance changes according to the value of a flowing current, for example, an organic EL element is developed and is being commercialized.

An organic EL element is a self light emitting element different from a liquid crystal element or the like. Consequently, in an organic EL display device, a light source (backlight) is unnecessary. As compared with a liquid crystal display device requiring a light source, visibility of an image is higher, power consumption is lower, and response of the element is faster.

As driving methods of an organic EL display device, like driving methods of a liquid crystal display device, there are a simple (passive) matrix method and an active matrix method. The former method has, although the structure is simple, a problem such that it is difficult to realize a large-size and high-resolution display device. Consequently, at present, an active matrix method as the latter method is actively developed. In the method, current flowing in organic EL elements disposed for pixels is controlled by an active element (generally, TFT (Thin Film Transistor)) provided in a drive circuit arranged for each of the organic EL elements.

It is generally known that the current-voltage (I-V) characteristic of an organic EL element deteriorates with lapse of time. In a pixel circuit for current-driving an organic EL element, when the I-V characteristic of the organic EL element changes with time, the value of current flowing in a drive transistor changes. Consequently, the value of current flowing in the organic EL element itself also varies, and the light emission luminance also changes accordingly.

There is a case that a threshold voltage Vth and mobility μ of the drive transistor change with time, or vary among pixel circuits due to variations in manufacturing processes. In the case where the threshold voltage Vth and the mobility μ of the drive transistor vary among pixel circuits, the value of current flowing in the drive transistor varies among pixel circuits. Consequently, even when the same voltage is applied to the gate of the drive transistor, the light emission luminance of the organic EL element varies, and uniformity of a screen deteriorates.

There is consequently a proposal for maintaining the light emission luminance of an organic EL element constant without being influenced by the variations, even when the I-V characteristic of the organic EL element changes with time, a threshold voltage Vth and mobility μ of a drive transistor changes with time or varies among pixel circuits. Concretely, a display device is proposed, having both a function of compensating fluctuations in the I-V characteristic of an organic EL element and a function of correcting fluctuations in the threshold voltage Vth and mobility μ of a drive transistor (refer to, for example, Japanese Unexamined Patent Application Publication No. 2008-33193).

SUMMARY OF THE INVENTION

At present, in the market of flat panel displays, the share of liquid crystal display televisions increases. A lower price as well as a larger and thinner screen promotes the willingness of consumers. Therefore, to promote sales of organic EL televisions each using an organic EL display device, it is important to realize lower price (lower cost).

As a method of realizing lower cost in an organic EL display device, for example, cost reduction in a driver IC (Integrated Circuit) as a component of a drive circuit is considered. Concretely, a data driver having a function of supplying a video signal to each of pixels in a driver IC generally expresses 10-bit gray-scale (1,024 gray-scale values) at present. The number of gray-scale values (the number of bits) may be reduced. In the case of simply reducing the number of gray-scale values which can be expressed, accordingly, the display picture quality also deteriorates. Therefore, proposal of a method for realizing higher picture quality while reducing cost is demanded. The above-described problem may occur not only in an organic EL display device but may similarly occur in other display devices using a self light emitting element.

It is therefore desirable to provide a display device realizing higher picture quality while reducing cost, a method of driving the same, and an electronic unit.

A display device according to an embodiment of the present invention has: a display section including a plurality of pixels each having a light emitting element and a pixel circuit; and a drive circuit performing display drive on the plurality of pixels through selecting each of the plurality of pixels to write a first signal voltage and a second signal voltage in this order into the selected pixel, the first and second signal voltages being provided based on a video signal. The drive circuit varies magnitude of each of the first and second signal voltages in accordance with a gray-scale value of the video signal, thereby performing gray-scale interpolation on a light emission luminance level for each of the light emitting elements.

An electronic unit according to an embodiment of the present invention has the display device according to an embodiment of the present invention.

A method of driving a display device, according to an embodiment of the invention, has steps of: performing display drive on a plurality of pixels in a display section, each pixel having a light emitting element and a pixel circuit through selecting each of the plurality of pixels to write a first signal voltage and a second signal voltage in this order into the selected pixel, the first and second signal voltages being provided based on a video signal, and at the time of the display drive, varying magnitude of each of the first and second signal voltages in accordance with a gray-scale value of the video signal, thereby performing gray-scale interpolation on a light emission luminance level for each of the light emitting elements.

In the display device, the method of driving the same, and the electronic unit as embodiments of the present invention, at the time of display drive on the plurality of pixels, by varying magnitude of each of the first and second signal voltages in accordance with a gray-scale value of the video signal, the gray-scale interpolation on a light emission luminance level for each of the light emitting elements is performed. Thus, expression of the larger number of gray-scale values than the number of gray-scale values which is originally provided by the video signal is realized.

In the display device, the method of driving the same, and the electronic unit according to embodiments of the present invention, at the time of display drive on the plurality of pixels, by varying magnitude of each of the first and second signal voltages in accordance with a gray-scale value of the video signal, the gray-scale interpolation on the light emission luminance for each of the light emitting elements is performed. Thus, expression of the larger number of gray-scale values than the number of gray-scale values which is originally provided by the video signal is realized. Therefore, while simplifying (without complicating) the configuration of the drive circuit, higher-precision gray-scale expression is performed. Further, while reducing cost, higher picture quality is realized.

Other and further objects, features and advantages of the invention will appear more fully from the following description.

DETAILED DESCRIPTION OF THE PREFERRED EMBODIMENTS

Embodiments of the present invention will be described in detail hereinbelow with reference to the drawings. The description will be given in the following order.

Figure 1:
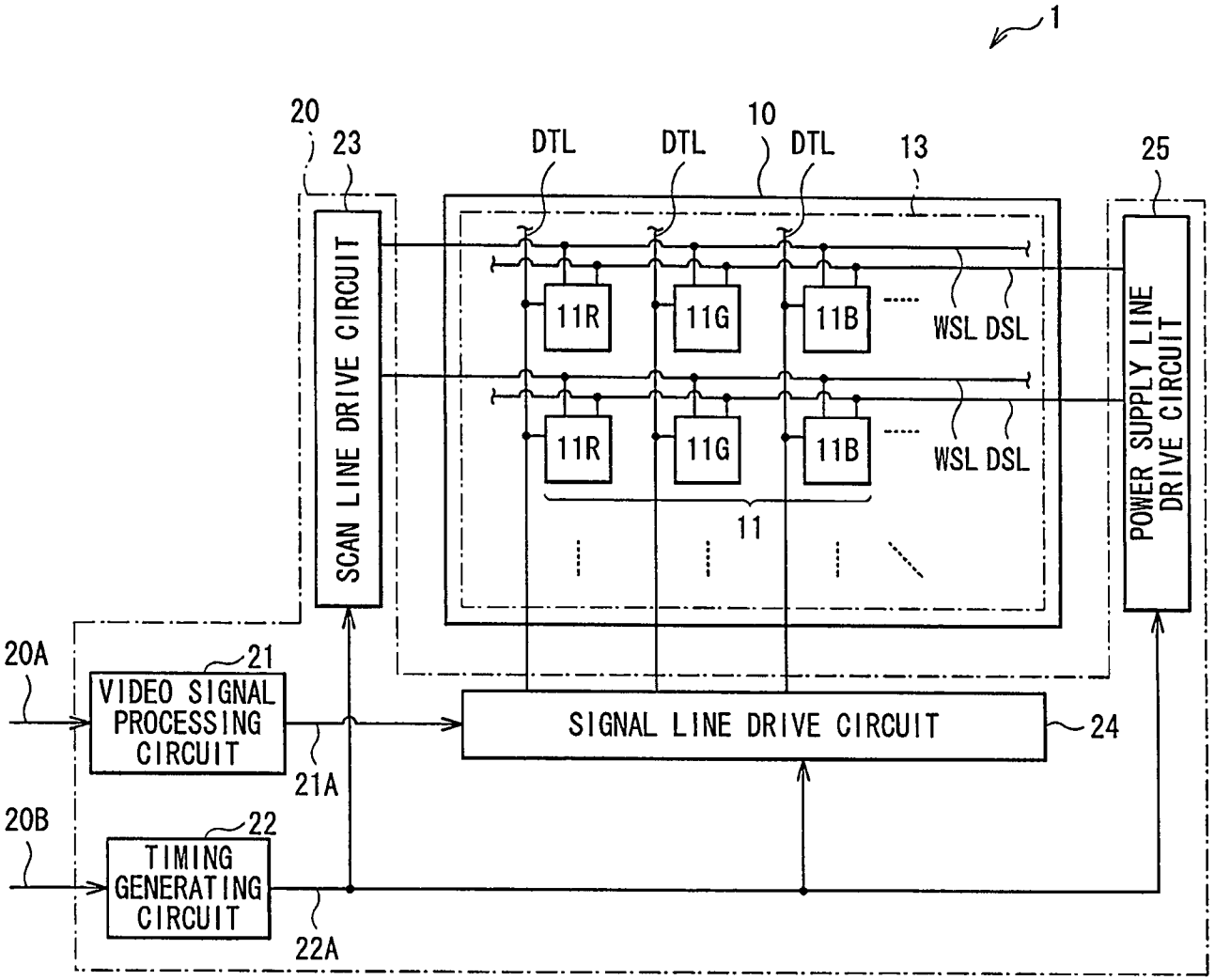
FIG. 1 is a configuration diagram illustrating an example of a display device according to an embodiment of the invention.

1. embodiment (example of gray-scale interpolation by conversion of signal voltage to three values (writing of a signal in two steps))
2. module and application example
3. modification Embodiment Configuration of Display device FIG. 1 is a block diagram illustrating a schematic configuration of a display device 1 according to an embodiment of the invention. The display device 1 has a display panel 10 (display section) and a drive circuit 20.

Display Panel 10

The display section 10 has a pixel array 13 in which a plurality of pixels 11 are arranged in a matrix, and displays an image on the basis of a video signal 20A and a synchronization signal 20B input from the outside by active matrix drive. Each pixel 11 is constructed by a pixel 11R for red, a pixel 11G for green, and a pixel 11B for blue. In the following, the pixels 11R, 11G, and 11B will be collectively called pixels 11.

The pixel array 13 also has a plurality of scan lines WSL disposed in rows, a plurality of signal lines DTL disposed in columns, and a plurality of power supply lines DSL disposed in rows along the scan lines WSL. One end of each of the scan lines WSL, the signal lines DTL, and the power supply lines DSL is connected to the drive,circuit 20 which will be described later. The pixels 11R, 11G, and 11B are disposed in rows and columns (in matrix) at intersections of the scan lines WSL and the signal lines DTL.

Figure 2:
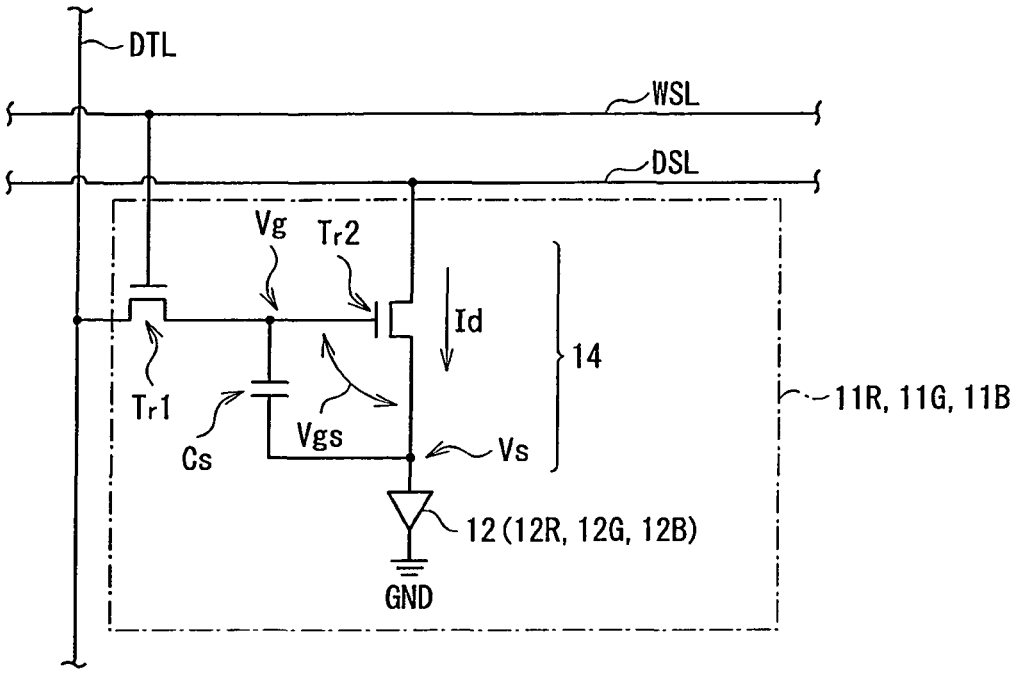
FIG. 2 is a circuit diagram illustrating an example of an internal configuration of a pixel in FIG. 1.

FIG. 2 shows an example of the internal configuration of the pixels 11R, 11G, and 11B. As illustrated in FIG. 2, the pixels 11R, 11G, and 11B have therein organic EL elements 12R, 12G, 12B (light emitting elements), respectively, and pixel circuits 14. In the following, the organic EL elements 12R, 12G, and 12B will be collectively called organic EL elements 12.

The pixel circuit 14 is constructed by a write (sampling) transistor Tr1 (first transistor), a drive transistor Tr2 (second transistor), and a retention capacitor Cs and has a circuit configuration of so-called "2Tr1C". Each of the write transistor Tr1 and the drive transistor Tr2 is formed by, for example, an n-channel MOS (Metal Oxide Semiconductor)-type TFT. The kind of the TFT is not particularly limited and may be of, for example, an inverted staggered structure (so-called bottom gate type) or a staggered structure (so-called top gate type).

In the pixel circuit 14, the gate of the write transistor Tr1 is connected to the scan line WSL, the drain is connected to the signal line DTL, and the source is connected to the gate of the drive transistor Tr2 and one end of the retention capacitor Cs. The drain of the drive transistor Tr2 is connected to the power supply line DSL, and the source is connected to the other end of the retention capacitor Cs and the anode of the organic EL element 12. The cathode of the organic EL element 12 is set to a fixed potential and, in this case, connected to a ground line GND, thereby being set to the ground (ground potential). The cathode of the organic EL element 12 functions as a common electrode of the organic EL elements 12 and is, for example, formed continuously over the entire display region of the display panel 10 and formed as a plate-shaped electrode.

Drive Circuit 20

The drive circuit 20 drives the pixel array 13 (display panel 10) (performs display drive). Concretely, as the details will be described later, the drive circuit 20 performs display drive on the plurality of pixels 11 (11R, 11G, and 11B) in the pixel array 13 through selecting each of the plurality of pixels 11 to write a signal voltage based on the video signal 20A into the selected pixels 11. As illustrated in FIG. 1, the drive circuit 20 has a video signal processing circuit 21, a timing generating circuit 22, a scan line drive circuit 23, a signal line drive circuit 24, and a power supply line drive circuit 25.

The video signal processing circuit 21 performs predetermined correction on the digital video signal 20A input from the outside and outputs the corrected video signal 21A to the signal line drive circuit 24. The predetermined correction is gamma correction, overdrive correction, or the like.

The timing generating circuit 22 generates a control signal 22A on the basis of the synchronization signal 20B input from the outside and outputs it, thereby performing control so that the scan line drive circuit 23, the signal line drive circuit 24, and the power supply line drive circuit 25 operate interlockingly.

The scan line drive circuit 23 selects a row of pixels from the plurality of pixels 11 (11R, 11G, and 11B) in succession, through applying a selection pulse to each of the plurality of scan lines WSL according to (synchronously with) the control signal 22A. Concretely, by selectively outputting a voltage Von to be applied when the write transistor Tr1 is set to the on state and a voltage Voff to be applied when the write transistor Tr1 is set to the off state, the above-described selection pulse is generated. The voltage Von has a value (constant value) equal to or larger than the on-state voltage of the write transistor Tr1, and the voltage Voff has a value (constant value) lower than the on-state voltage of the write transistor Tr1.

The signal line drive circuit 24 generates an analog video signal corresponding to the video signal 21A input from the video signal processing circuit 21 according to (synchronously with) the control signal 22A, and applies the analog video signal to the signal lines DTL. Concretely, by applying an analog signal voltage based on the video signal 21A to each of the signal lines DTL, the signal line drive circuit 24 writes a video signal into the pixel 11 (11R, 11G, or 11B) (to be selected) selected by the scan line drive circuit 23. Writing of a video signal denotes application of a predetermined voltage across the gate and the source of the drive transistor Tr2.

The signal line drive circuit 24 outputs three voltages (voltage of three values); a gray-scale interpolation voltage Vsig1 (first signal voltage) as signal voltage based on the video signal 20A, a signal voltage Vsig2 (second signal voltage), and a voltage Vofs. In the embodiment, the signal line drive circuit 24 applies the two signal voltages to each of the signal lines DTL in order of the gray-scale interpolation voltage Vsig1 and the signal voltage Vsig2, and varies the magnitudes of each of the gray-scale interpolation voltage Vsig1 and the signal voltage Vsig2. In such a manner, although the details will be described later, gray-scale interpolation on the light emission luminance level for each of the organic EL elements 12 is performed. On the other hand, the voltage Vofs is a voltage to be applied to the gate of the drive transistor Tr2 when the light of the organic EL element 12 is off. Concretely, the voltage Vofs is set so that, when a threshold voltage of the drive transistor Tr2 is Vth, (Vofs−Vth) becomes a voltage value (constant value) lower than a voltage value (Vel+Vca) obtained by adding a threshold voltage Vel in the organic EL element 12 and a cathode voltage Vca.

The power supply line drive circuit 25 controls the light emitting operation and the light-off operation on each of the organic EL elements 12, through applying a control pulse to each of the plurality of power supply lines DSL in succession according to (synchronously with) the control signal 22A. Concretely, by selectively outputting a voltage Vcc applied when current Id is passed to the drive transistor Tr2 and a voltage Vini applied when the current Id is not passed to the drive transistor Tr2, the power supply line drive circuit 25 generates the control pulse. The voltage Vini is set so as to have a voltage value (constant value) lower than a voltage value (Vel+Vca) obtained by adding the threshold voltage Vel and the cathode voltage Vca in the organic EL element 12. On the other hand, the voltage Vcc is set to have a voltage value (constant value) equal to or larger than the voltage value (Vel+Vca).

Action and Effect of Display device

Subsequently, the action and effect of the display device 1 of the embodiment will be described.

1. Outline of Display Operation

In the display device 1, as illustrated in FIGS. 1 and 2, the drive circuit 20 performs display drive based on the video signal 20A and the synchronization signal 20B on the pixels 11 (11R, 11G, and 11B) in the display panel 10 (the pixel array 13). By the display drive, drive current is injected into the organic EL elements 12 in the pixels 11, holes and electrons are recombined, and light emission occurs. Light in the light emission is multiple-reflected between an anode (not illustrated) and a cathode (not illustrated) in the organic EL element 12, passes through the cathode or the like, and is extracted to the outside. As a result, an image based on the video signal 20A is displayed on the display panel 10.

Details of Display Operation

Figure 3:
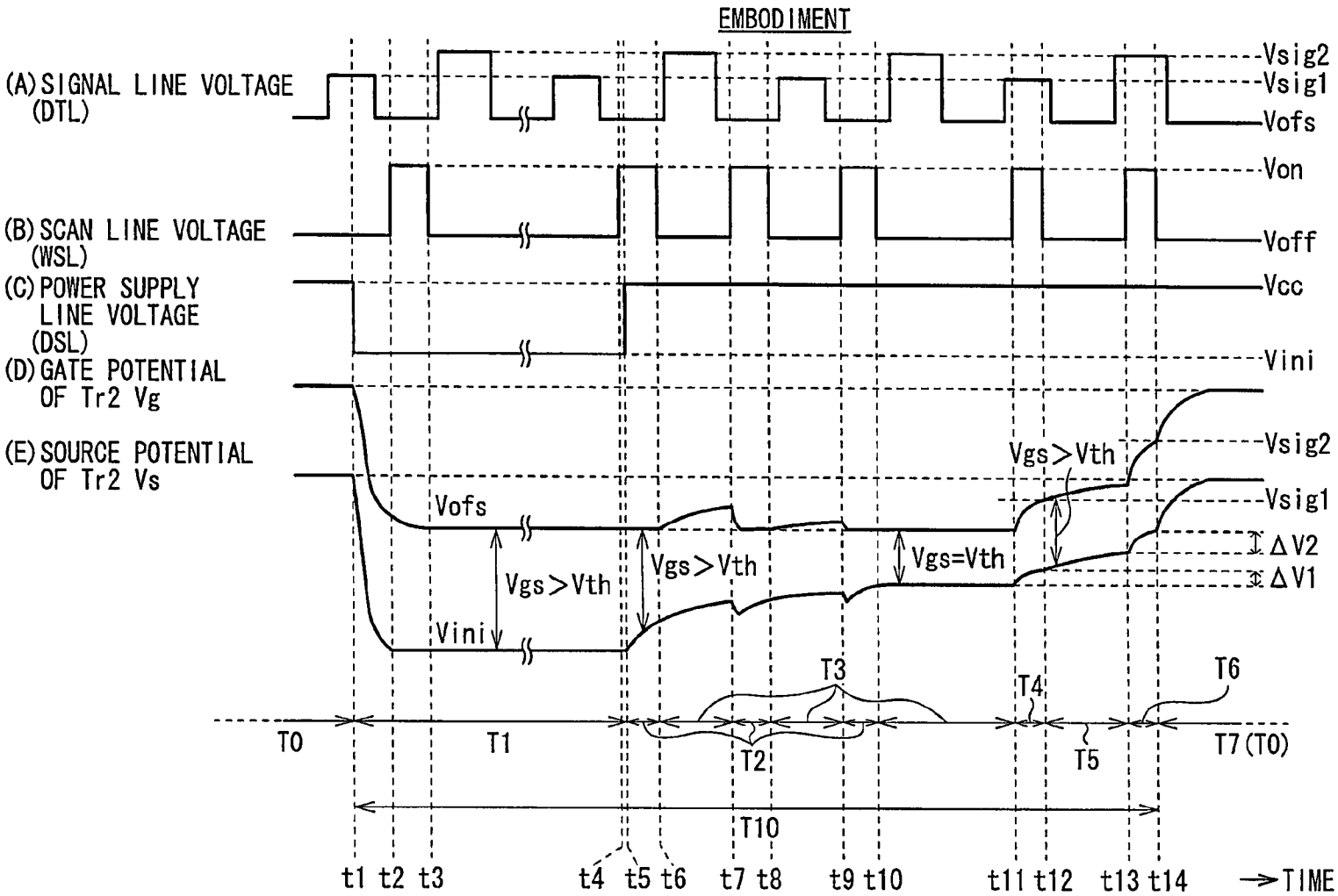
FIG. 3 is a timing waveform chart expressing an example of the operation of the display device according to the embodiment.

FIG. 3 is a timing chart illustrating an example of various waveforms in display operation of the display device 1 (display drive of the drive circuit 20). Parts (A) to (C) in FIG. 3 illustrate voltage waveforms of the signal line DTL, the scan line WSL, and the power supply line DSL, respectively. Concretely, FIG. 3 illustrates a state (part (A) in FIG. 3) in which the voltage of the signal line DTL changes periodically between the voltage Vofs, the gray-scale interpolation voltage Vsig1, and the signal voltage Vsig2, a state (part (B) in FIG. 3) where the voltage of the scan line WSL changes periodically between the voltages Voff and Von, and a state (part (C) in FIG. 3) where the voltage of the power supply line DSL changes periodically between the voltages Vcc and Vini. Parts (D) and (E) in FIG. 3 show waveforms of gate potential Vg and source potential Vs, respectively, in the drive transistor Tr2.

Vth Correction Preparation Period T1: t1 to t5

First, after end (timing t1) of light emission period T0, the drive circuit 20 prepares for correction of the threshold voltage Vth (Vth correction) in the drive transistor Tr2 in each of the pixels 11 (11R, 11G, and 11B). Concretely, at the timing t1, the power supply line drive circuit 25 decreases the voltage of the power supply line DSL from the voltage Vcc to the voltage Vini (part (C) in FIG. 3). Between timings t2 and t3 in the period in which the voltage of the signal line DTL is the voltage Vofs and the voltage of the power supply line DSL is the voltage Vini, the scan line drive circuit 23 increases the voltage of the scan line WSL to the voltage Von from the voltage Voff (part (B) in FIG. 3). Accordingly, the source potential Vs of the drive transistor Tr2 decreases to the voltage Vini (part (E) in FIG. 3), and the organic EL element 12 turns off. The period from the timing t1 to timing t14 at which light emitting operation to be described later starts is a light-off period T10 in which the organic EL element 12 is in the light-off state. On the other hand, as the source potential Vs decreases, the gate potential Vg of the drive transistor Tr2 also decreases due to capacity coupling via the retention capacitor Cs (part (D) in FIG. 3). As described above, when the voltage of the scan line WSL becomes the voltage Von and the write transistor Tr1 enters the on state, the gate potential Vg of the drive transistor Tr2 finally becomes the voltage Vofs corresponding to the voltage of the signal line DTL (part (D) in FIG. 3). As illustrated in FIG. 3, the gate-source voltage Vgs in the drive transistor Tr2 becomes larger than the threshold voltage Vth of the drive transistor Tr2 (Vgs >Vth), and preparation for the Vth correction completes. After that, at timing t4 in a period in which the voltage of the signal line DTL is the voltage Vofs and the voltage of the power supply line DSL is the voltage Vini, the scan line drive circuit 23 increases the voltage of the scan line WSL from the voltage Voff to the voltage Von (part (B) in FIG. 3).

First Vth Correction Period: t5 to t6

Next, the drive circuit 20 performs a first Vth correction in the drive transistor Tr2. Concretely, first, at timing t5 in a period in which the voltage of the signal line DTL is the voltage Vofs and the voltage of the scan line WSL is the voltage Von, the power supply line drive circuit 25 increases the voltage of the power supply line DSL from the voltage Vini to the voltage Vcc (part (C) in FIG. 3). The current Id then flows between the drain and the source of the drive transistor Tr2 and the source potential Vs rises (part (E) in FIG. 3). Next, at timing t6 in a period in which the voltages of the signal line DTL and the power supply line DSL are held as the voltages Vofs and Vcc, respectively, the scan line drive circuit 23 decreases the voltage of the scan line WSL from the voltage Von to the voltage Voff (part (B) in FIG. 3). By the operation, the write transistor Tr1 enters the off state. Accordingly, the gate of the drive transistor Tr2 is floating, and the Vth correction stops temporarily (the period shifts to a first Vth correction pause period T3).

First Vth Correction Pause Period T3: t6 to t7

In the period from the timing t6 to the timing t7, as described above, the Vth correction stops temporarily. However, in the case where the first Vth correction is insufficient, that is, in the case where the gate-source voltage Vgs in the drive transistor Tr2 is still larger than the threshold voltage Vth of the drive transistor Tr2 (Vgs>Vth), the operation is performed as follows. Specifically, since the gate-source voltage Vgs is larger than the threshold voltage Vth of the drive transistor Tr2 (Vgs>Vth) also in the Vth correction pause period T3, the current Id still flows between the drain and the source of the drive transistor Tr2, and the source potential Vs continues rising (part (E) in FIG. 3). On the other hand, the gate potential Vg of the drive transistor Tr2 also rises due to the capacity coupling via the retention capacitor Cs as the source potential Vs rises (part (D) in FIG. 3).

Second Vth Correction Period T2: t7 to t8

Next, the drive circuit 20 performs the Vth correction in the drive transistor Tr2 again (second Vth correction). Concretely, first, at timing t7 in a period in which the voltage of the signal line DTL is the voltage Vofs and the voltage of the power supply line DSL is the voltage Vcc, the scan line drive circuit 23 increases the voltage of the scan line WSL from the voltage Voff to the voltage Von (part (B) in FIG. 3). Accordingly, the write transistor Tr1 enters the on state, so that the gate potential Vg of the drive transistor Tr2 becomes again the voltage Vofs corresponding to the voltage of the signal line DTL (part (D) in FIG. 3). In the case where the source voltage Vs of the drive transistor Tr2 is lower than the voltage value (Vofs(=Vg)−Vth) (Vs<(Vg−Vth)), in other words, in the case where the gate-source voltage Vgs is still larger than the threshold voltage Vth (Vgs>Vth; the case where the Vth correction has not been completed yet), the operation is performed as follows. Specifically, until the drive transistor Tr2 cuts off (until Vgs becomes equal to Vth), in a manner similar to the first Vth correction period, the current Id flows between the drain and the source of the drive transistor Tr2 and the source potential Vs continuously rises (part (E) in FIG. 3). In this case, however, before Vgs becomes equal to Vth, the Vth correction is temporarily stopped again. In other words, thereafter, at timing t8 in a period in which the voltages of the signal line DTL and the power supply line DSL are held as the voltage Vofs and Vcc, respectively, the scan line drive circuit 23 decreases the voltage of the scan line WSL from the voltage Von to the voltage Voff (part (B) in FIG. 3). By the operation, the write transistor Tr1 enters the off state, so that the gate of the drive transistor Tr2 becomes floating, and the Vth correction stops temporarily again (the period shifts to the second Vth correction pause period T3).

Second Vth Correction Pause Period T3: t8 to t9

In the period from the timing t8 to the timing t9, as described above, the Vth correction stops temporarily again. In this case, however, since the second Vth correction is insufficient (Vgs>Vth), the current Id still flows between the drain and the source of the drive transistor Tr2 in the second Vth correction pause period T3, and the source potential Vs continues rising (part (E) in FIG. 3). Like in the first Vth correction pause period T3, the gate potential Vg of the drive transistor Tr2 also rises due to the capacity coupling via the retention capacitor Cs (part (D) in FIG. 3).

Third Vth Correction Period T2 and Third Vth Correction Pause Period T3: t9 to t11

Next, the drive circuit 20 performs the Vth correction in the drive transistor Tr2 again (performs the third Vth correction). Concretely, first, at timing t9 in a period in which the voltage of the signal line DTL is the voltage Vofs and the voltage of the power supply line DSL is the voltage Vcc, the scan line drive circuit 23 increases the voltage of the scan line WSL from the voltage Voff to the voltage Von (part (B) in FIG. 3). Accordingly, the write transistor Tr1 enters the on state, so that the gate potential Vg of the drive transistor Tr2 becomes again the voltage Vofs corresponding to the voltage of the signal line DTL (part (D) in FIG. 3). Like in the Vth correction period T2, until the drive transistor Tr2 cuts off (until Vgs becomes equal to Vth), the current Id flows between the drain and the source of the drive transistor Tr2, and the source potential Vs continuously rises (part (E) in FIG. 3). As illustrated in FIG. 3, it is assumed that Vgs becomes equal to Vth at the end of the third Vth correction period T2 and the Vth correction completes. Specifically, the retention capacitor Cs is charged so that the voltage across the both ends becomes the threshold voltage Vth and, as a result, the gate-source voltage Vgs in the drive transistor Tr2 becomes the threshold voltage Vth. Thereafter, at timing t10 in a period in which the voltages of the signal line DTL and the power supply line DSL are held as the voltages Vofs and Vcc, respectively, the scan line drive circuit 23 decreases the voltage of the scan line WSL from the voltage Von to the voltage Voff (part (B) in FIG. 3). By the operation, the write transistor Tr1 enters the off state, so that the gate of the drive transistor Tr2 becomes floating and, as a result, the gate-source voltage Vgs can be held as the threshold voltage Vth regardless of the magnitude of the subsequent voltage of the signal line DTL. The period from the timing t10 to timing t11 which will be described later is a third Vth correction pause period T3.

In such a manner, the Vth correction period T2 and the Vth correction pause period T3 are repeated a few times (three times each in the embodiment) to set the gate-source voltage Vgs to the threshold voltage Vth (perform the Vth correction), thereby obtaining the following effects. Specifically, even in the case where the threshold voltage Vth of the drive transistor Tr2 varies among the pixels 11 (11R, 11G, and 11B), the light emission luminance of the organic EL element 12 can be prevented from varying.

Mobility Correction/Gray-scale Interpolation Write Period T4: t11 to t12

Next, as described below, the drive circuit 20 performs correction of the mobility (first mobility correction) in the drive transistor Tr2 while writing the gray-scale interpolation voltage Vsig1 (gray-scale interpolation writing). Concretely, first, at timing t11 in a period in which the voltage of the signal line DTL is the gray-scale interpolation voltage Vsig1 and the voltage of the power supply line DSL is the voltage Vcc, the scan line drive circuit 23 increases the voltage of the scan line WSL from the voltage Voff to the voltage Von (part (B) in FIG. 3). By the operation, the write transistor Tr1 enters the on state, so that the gate potential Vg of the drive transistor Tr2 increases from the voltage Vofs to the gray-scale interpolation voltage Vsig1 corresponding to the voltage of the signal line DTL at this time (part (D) in FIG. 3). At this stage, the anode voltage of the organic EL element 12 is smaller than the voltage value (Vel+Vca) obtained by adding the threshold voltage Vel and the cathode voltage Vca in the organic EL element 12, so that the organic EL element 12 is in the cutoff state. In other words, at this stage, no current flows between the anode and the cathode of the organic EL element 12 (the organic EL element 12 does not emit light). Therefore, the current Id supplied from the drive transistor Tr2 flows to a device capacitor (not illustrated) existing in parallel between the anode and the cathode of the organic EL element 12, and the device capacitor is charged. As a result, the source potential Vs of the drive transistor Tr2 rises only by a potential difference ΔV1 (part (E) in FIG. 3), and the gate-source voltage Vgs becomes (Vsig1+Vth−ΔV1).

As the mobility μ of the drive transistor Tr2 increases, the rise amount of the source potential Vs (the potential difference ΔV1) also increases. Consequently, as described above, by setting the gate-source voltage Vgs to be smaller only by the amount of the potential difference ΔV1 before light emission which will be described later (by a feedback), variations in the mobility μ in each pixel 11 are eliminated. However, as will be described below, since such mobility correction is temporarily stopped, variations in the mobility μ in each pixel 11 are not effectively removed. In such a manner, concurrently with the gray-scale interpolation writing, the first mobility correction is made.

Bootstrap Period T5: t12 to t13

Next, at timing t12 in a period in which the voltage of the signal line DTL is maintained at the gray-scale correction voltage Vsig1 and the voltage of the power supply line DSL is maintained at the voltage Vcc, the scan line drive circuit 23 decreases the voltage of the scan line WSL from the voltage Von to the voltage Voff (part (B) in FIG. 3). By the operation, the write transistor Tr1 enters the off state, so that the gate of the drive transistor Tr2 becomes floating, and the mobility correction temporarily stops. At this time, the source potential Vs of the drive transistor Tr2 is also a floating potential and, as illustrated in FIG. 3, the gate-source voltage Vgs is again larger than the threshold voltage Vth (Vgs>Vth). Consequently, the drive transistor Tr2 bootstraps, and the source potential Vs rises (part (E) in FIG. 3: bootstrap period T5). In other words, also in the bootstrap period T5, operation similar to the above-described mobility correction is performed. However, in this case, since the gate of the drive transistor Tr2 is floating as described above, the gate potential Vg of the drive transistor Tr2 also rises due to capacity coupling via the retention capacitor Cs (part (D) in FIG. 3).

Mobility Correction/Signal Writing Period T6: t13 to t14

Next, as described below, the drive circuit 20 performs the second mobility correction while performing writing of the signal voltage Vsig2 (signal writing). Concretely, first, at timing t13 in a period in which the voltage of the signal line DTL is the signal voltage Vsig2 and the voltage of the power supply line DSL is the voltage Vcc, the scan line drive circuit 23 increases the voltage of the scan line WSL from the voltage Voff to the voltage Von (part (B) in FIG. 3). By the operation, the write transistor Tr1 enters the on state, so that the gate potential Vg of the drive transistor Tr2 rises to the signal voltage Vsig2 corresponding to the voltage of the signal line DTL at this time (part (D) in FIG. 3). At this stage, the anode voltage of the organic EL element 12 is still smaller than the voltage value (Vel+Vca) obtained by adding the threshold voltage Vel and the cathode voltage Vca in the organic EL element 12, so that the organic EL element 12 is still in the cutoff state. In other words, still at this stage, no current flows between the anode and the cathode of the organic EL element 12 (the organic EL element 12 does not emit light). Therefore, the current Id supplied from the drive transistor Tr2 flows to the device capacitor (not illustrated) in the organic EL element 12, and the device capacitor is charged. As a result, the source potential Vs of the drive transistor Tr2 rises only by a potential difference ΔV2 (part (E) in FIG. 3), and the gate-source voltage Vgs becomes (Vsig2+Vth−(ΔV1+ΔV2)).

As the mobility μ of the drive transistor Tr2 increases, in a manner similar to the first mobility correction, the rise amount of the source potential Vs (the potential difference ΔV2) also increases. Consequently, as described above, by setting the gate-source voltage Vgs to be further smaller only by the amount of the potential difference ΔV2 before light emission which will be described later, variations in the mobility μ in each pixel 11 are effectively eliminated. In such a manner, the second mobility correction is made concurrently with the signal writing.

Light Emission Period T7 (T0): t14 or later

Next, at timing t14 in a period in which the voltage of the signal line DTL is maintained at the gray-scale interpolation voltage Vsig2 and the voltage of the power supply line DSL is maintained at the voltage Vcc, the scan line drive circuit 23 decreases the voltage of the scan line WSL from the voltage Von to the voltage Voff (part (B) in FIG. 3). By the operation, the write transistor Tr1 enters the off state, so that the gate of the drive transistor Tr2 becomes floating. In a state where the gate-source voltage Vgs of the drive transistor Tr2 is held constant, the current Id flows between the drain and the source of the drive transistor Tr2. As a result, the source potential Vs of the drive transistor Tr2 rises (part (E) in FIG. 3) and the gate potential Vg of the drive transistor Tr2 also rises interlockingly by capacity coupling via the retention capacitor Cs (part (D) in FIG. 3). Accordingly, the anode voltage of the organic EL element 12 becomes larger than the voltage value (Vel+Vca) obtained by adding the threshold voltage Vel and the cathode voltage Vca in the organic EL element 12. Therefore, the current Id flows between the anode and the cathode of the organic EL element 12, and the organic EL element 12 emits light with desired luminance (light emission period T7 (T0)).

Repetition

Next, after lapse of a predetermined period, the drive circuit 20 completes the light emission period T7 (T0). Concretely, in a manner similar to the above, at timing t1, the power supply line drive circuit 25 decreases the voltage of the power supply line DSL from the voltage Vcc to the voltage Vini (part (C) in FIG. 3). The source potential Vs of the drive transistor Tr2 then decreases, and finally becomes the voltage Vini (part (E) in FIG. 3). Consequently, the anode voltage of the organic EL element 12 becomes smaller than the voltage value (Vel+Vca) obtained by adding the threshold voltage Vel and the cathode voltage Vca in the organic EL element 12, so that the current Id does not flow between the anode and the cathode. As a result, at the timing t1 or later, the organic EL element 12 is turned off (the operation shifts to the light-off period T10). Thereafter, the drive circuit 20 performs display drive so that the periods T1 to T7 (T0) described until now are repeated periodically every frame period. Simultaneously, the drive circuit 20 scans, for example, the power supply lines DSL and the scan lines WSL with selection pulse and the control pulse, respectively in the row direction every horizontal period (1H period). In such a manner, the display operation in the display device 1 (the display drive by the drive circuit 20) is performed.

3. Gray-scale Interpolation

Subsequently, the gray-scale interpolation (gray-scale interpolation on the light emission luminance for each of the organic EL elements 12) by the drive circuit 20 as one of features in the display operation in the display device 1 of the embodiment will be described in comparison with the display operation of a comparative example.

3-1. Display Operation of Comparative Example

Figure 4:
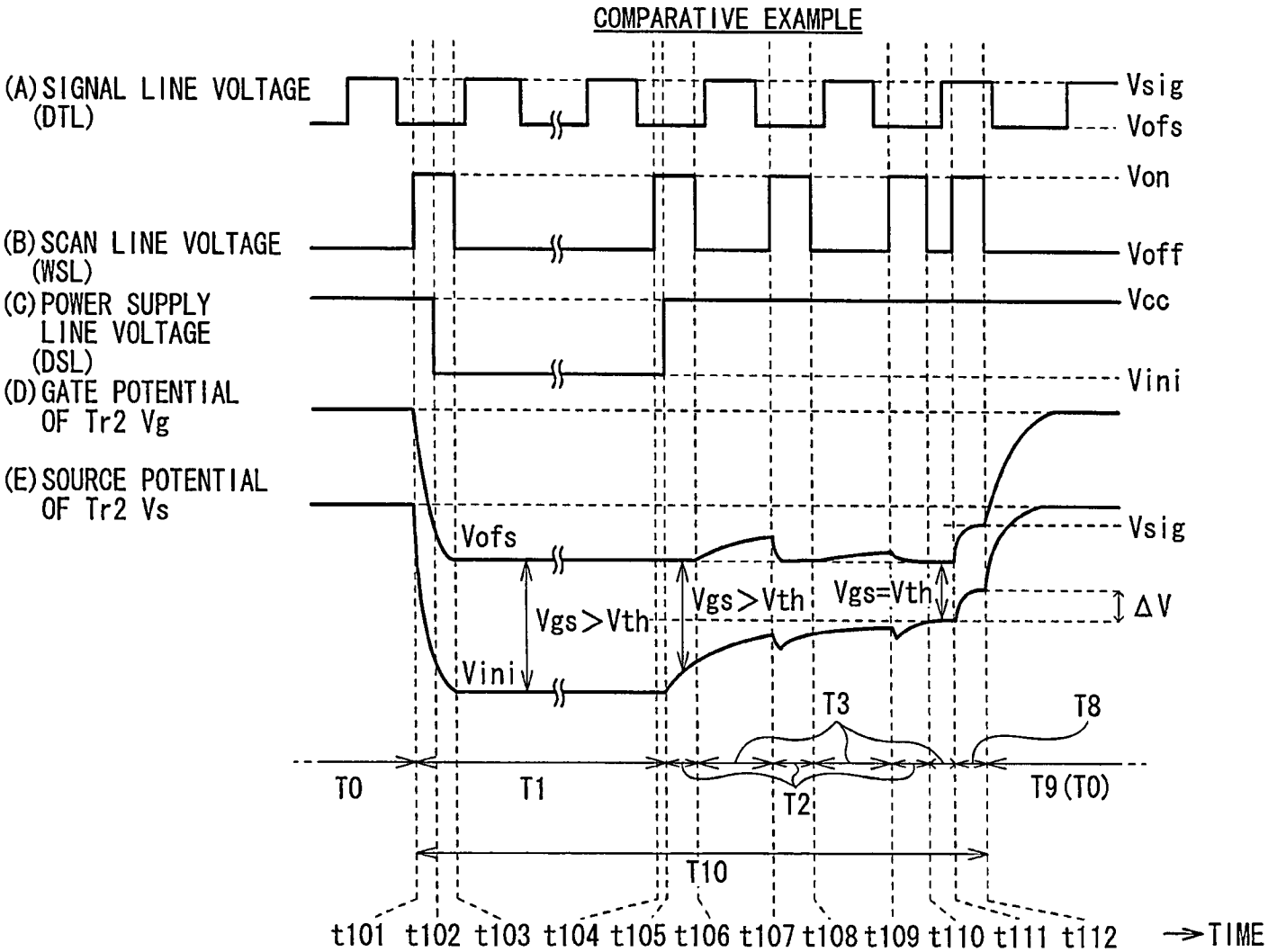
FIG. 4 is a timing waveform chart expressing an example of the operation of a display device according to a comparative example.

FIG. 4 is a timing chart illustrating an example of various waveforms in display operation in a display device of related art according to a comparative example (timing t101 to timing t112). Like parts (A) to (C) in FIG. 3, parts (A) to (C) in FIG. 4 illustrate voltage waveforms of the signal line DTL, the scan line WSL, and the power supply line DSL, respectively. Different from part (A) in FIG. 3, part (A) in FIG. 4 illustrates a state where the voltage of the signal line DTL changes periodically between the voltage Vofs and the signal voltage Vsig (voltages of two values). Like parts (D) and (E) in FIG. 3, parts (D) and (E) in FIG. 4 illustrate waveforms of the gate potential Vg and the source potential Vs, respectively, in the drive transistor Tr2.

In the display operation of the comparative example, the operation in the period between timing t101 and timing t111 (the Vth correction preparation period T1, the first to third Vth correction periods T2, and the first to third Vth correction pause periods) is basically the same as the display operation of the display device 1 (the operation in the period between the timing t1 and timing t11 in FIG. 3). In other words, as described above, except that the voltage of the signal line DTL has two values (the voltage Vofs and the signal voltage Vsig), the Vth correction operation similar to that of the display device 1 is performed.

On the other hand, in the display operation of the comparative example, the operation in the period between timings t111 and t112 (mobility correction/signal writing period T8) is different from that in the period between timings t11 and t14 in the display device 1. In other words, in the comparative example, different from the operation of the display device 1 to be described below, the signal writing and mobility correction is performed only once of the mobility correction/signal writing period T8. Concretely, operation of writing the signal voltage Vsig corresponding to the video signal 20A input from the outside and mobility correction similar to the above (in the comparative example, the source potential Vs is increased only by the potential difference ΔV) are performed. The operation in the light emission period T9 (T0) at timing t112 and later is basically similar to the operation in the light emission period T7 (T0) in the display device 1.

Figure 5A:
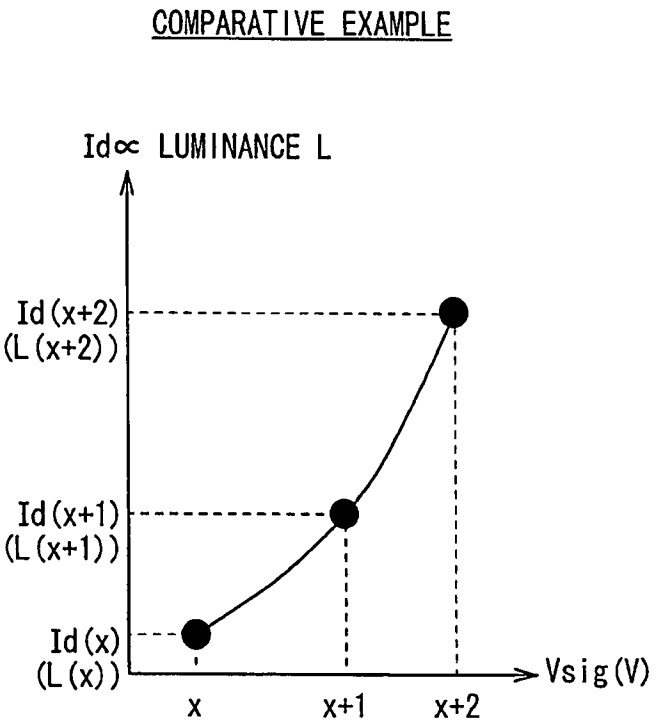
FIGS. 5A and 5B are characteristic diagrams illustrating an example of the relation between signal voltage and current (light emission luminance of the organic EL element) flowing in a drive transistor in display devices of a comparative example and the embodiment.

In the display operation of the comparative example, the relation (gamma curve) between the signal voltage Vsig and the current Id flowing in the drive transistor Tr2 (proportional to the light emission luminance L of the organic EL element 12) is, for example, as illustrated in FIG. 5A. In other words, as the gray-scale value of the signal voltage Vsig provided by the video signal 20A increases like, for example, voltages x, x+1, x+2, . . . , the gray-scale value of the current Id (light emission luminance L) also increases in a one-to-one corresponding manner. Concretely, when the signal voltage Vsig is set to the voltage x, the current Id has a current value Id(x), and the light emission luminance L has luminance L(x). Similarly, when the signal voltage Vsig is set to the voltage (x+1), the current Id has a current value Id(x+1), and the light emission luminance L has luminance L(x+1). When the signal voltage Vsig is set to the voltage (x+2), the current Id has a current value Id(x+2), and the light emission luminance L has luminance L(x+2). From the above, in the case of using the display operation of the comparative example, the number of gray-scale values of the light emission luminance L is uniquely determined according to the number of gray-scale values (the number of bits of the video signal 20A) which can be provided by the video signal 20A, in other words, the number of voltage values which can be provided by the signal voltage Vsig. Concretely, for example, in the case where the video signal 20A is a signal of eight bits, the number of gray-scale values of the light emission luminance L which can be expressed is $2^8$=256. For example, in the case where the video signal 20A is a signal of 10 bits, the number of gray-scale values of the light emission luminance L which can be expressed is $2^{10}$=1024.

Therefore, as one of methods for realizing lower cost of the display device as a whole, for example, in the case of reducing the cost of a data driver (corresponding to the signal line drive circuit 24), in the display device using the display operation of the comparative example, the following problems occur. For example, the cost of the data driver may be reduced by decreasing the number of gray-scale values which can be provided by the video signal 20A (the number of bits of the video signal 20A). In the case of using the display operation of the comparative example, accompanying the reduction, the number of gray-scale values of the light emission luminance L which can be expressed also decreases. Concretely, to realize lower cost with respect to the 10-bit gray-scale (1,024 gray-scale values) which is common at present, the number of gray-scale values has to be decreased to, for example, the 8-bit gray-scale (256 gray-scale values). As the number of gray-scale, values of the light emission luminance L which can be expressed decreases, the display quality also deteriorates. Therefore, in the case of using the display operation of the comparative example, it is difficult to realize higher picture quality while achieving lower cost (both lower cost and higher picture quality).

3-2. Gray-scale Interpolation In Embodiment

In contrast, in the display device 1 of the embodiment, first, different from the comparative example, the signal writing operation is performed in two steps. Concretely, as illustrated in FIG. 3, in the period between timings t11 and t14, the two mobility correction/signal writing periods (the mobility correction/gray-scale interpolation write period T4 and the mobility correction/signal write period T6) are provided while sandwiching the bootstrap period T5. The signal line drive circuit 24 can output three voltages (voltage of three values) of the gray-scale interpolation voltage Vsig1 and the signal voltage Vsig2 that are signal voltages based on the video signal 20A, and the voltage Vofs. The signal line drive circuit 24 applies the two signal voltages to the signal lines DTL in order of the gray-scale interpolation voltage Vsig1 and the signal voltage Vsig2 as illustrated in FIG. 3 and, as will be described below, varies the magnitude of each of the gray-scale interpolation voltage Vsig1 and the signal voltage Vsig2.

Figure 5B:
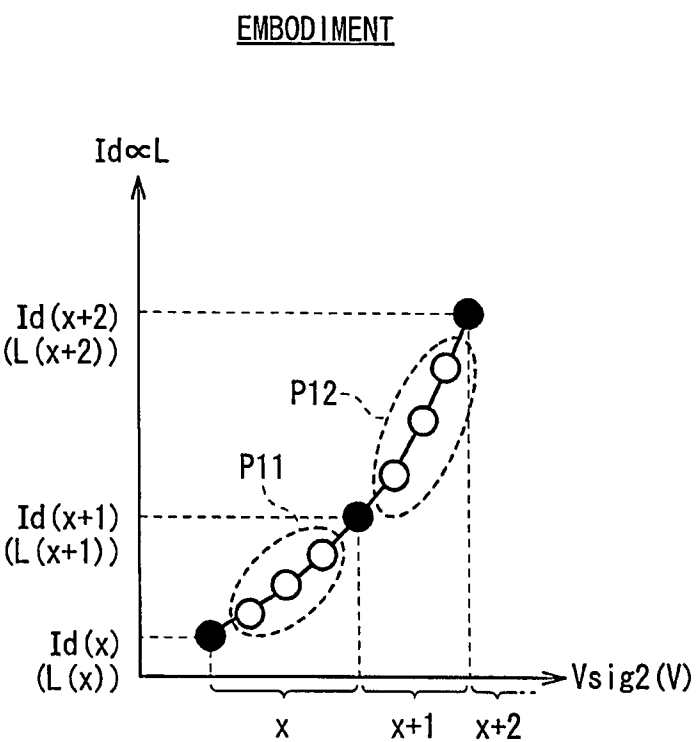

In the display device 1, for example, as shown by reference numerals P11 and P12 in FIG. 5B, gray-scale interpolation on the light emission luminance L for each of the organic EL elements 12 is performed. As a result, in the display device 1, expression of the number of gray-scale values larger than the number of gray-scale values which can be originally provided by the video signal 20A is realized. Concretely, for example, in the case where the voltage x set as the signal voltage Vsig illustrated in FIG. 5A has 8-bit gray-scale, in FIG. 5B, gray-scale value of two bits (four gray-scale values) is interpolated for the 8-bit gray-scale (refer to reference numerals P11 and P12), so that 10-bit gray-scale is realized. In other words, as described specifically below, by using a voltage y or the like (interpolation gray-scale voltage) set in the gray-scale interpolation voltage Vsig1 with respect to the voltage x or the like (reference gray-scale voltage provided by the signal voltage Vsig2), gray-scale value of two bits (four gray-scale values) is interpolated, and gray-scale value of total ten bits is obtained.

Such a gray-scale interpolation will be described more concretely as follows. First, the signal line drive circuit 24 fixedly sets, for example, as illustrated in parts (A) to (D) in FIG. 6, the signal voltage Vsig2 to a voltage (in this case, voltage x) corresponding to one of a plurality of gray-scale values (in this case, 8-bit gray-scale=256 gray-scale values) which can be provided by the video signal 20A. Next, for example, as illustrated by an arrow P21 in part (A) of FIG. 6, the signal line drive circuit 24 makes the gray-scale interpolation voltage Vsig1 change among a plurality of voltages (in this case, four voltages of (y−3), (y−2), (y−1), and y). The signal line drive circuit 24 repeats the operation of fixedly setting the signal voltage Vsig2 to another gray-scale in the above-described plural gray-scale values and making the gray-scale interpolation voltage Vsig1 change again among the plural voltages.

Figure 6:
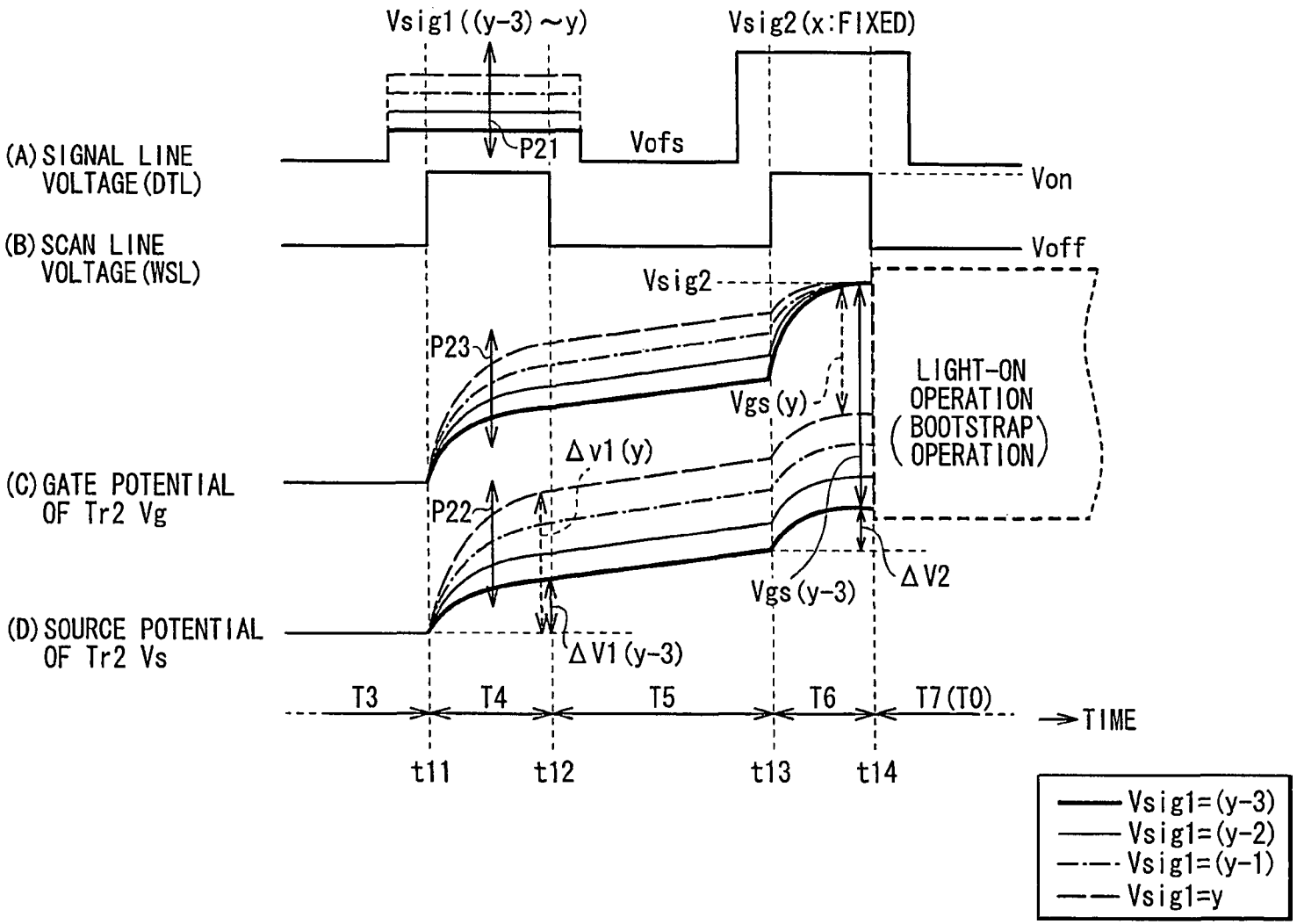
FIG. 6 is a timing waveform chart for explaining changes in gate potential and source potential of a drive transistor when a gray-scale interpolation voltage is changed.

As illustrated by arrows P21 and P22 in parts (A) and (B) in FIG. 6, as the magnitude of the gray-scale interpolation voltage Vsig1 rises from the voltage (y−3) to the voltage y, the rise in the source potential Vs of the drive transistor Tr2 after completion of writing of the gray-scale interpolation voltage Vsig1 also becomes larger. Concretely, for example, the rise amount (the potential difference ΔV1(y)) of the source potential Vs when the gray-scale interpolation voltage Vsig1 is set to the voltage y is larger than the rise amount (the potential difference ΔV1(y−3) by the first mobility correction) of the source potential Vs when the gray-scale interpolation voltage Vsig1 is set to the voltage (y−3). At this time, in the mobility correction/gray-scale interpolation write period T4, as illustrated by an arrow P23 in part (C) of FIG. 6, as the source potential Vs of the drive transistor Tr2 rises, the gate potential Vg of the drive transistor Tr2 also rises interlockingly. In other words, as the magnitude of the gray-scale interpolation voltage Vsig1 rises from the voltage (y−3) to the voltage y, the rise in the gate potential Vg after completion of writing of the gray-scale interpolation voltage Vsig1 also increases.

On the other hand, in the mobility correction/signal writing period T6, as illustrated in part (D) in FIG. 6, the rise amount (the potential difference ΔV2 by the second mobility correction) of the source potential Vs in the drive transistor Tr2 is constant regardless of the magnitude of the gray-scale interpolation voltage Vsig1. The reason is that, as described above, the rise amount (the potential difference ΔV2) in the source potential Vs in the period is determined by the magnitude (in this case, the voltage x) of the signal voltage Vsig2 to be written. After completion of the period, as described above, the gate potential Vg of the drive transistor Tr2 becomes the signal voltage Vsig2 (in this case, the voltage x) (part (C) in FIG. 6). Consequently, as understood from FIG. 6, as the magnitude of the gray-scale interpolation voltage Vsig1 rises from the voltage (y−3) to the voltage y, the gate-source voltage Vgs of the drive transistor Tr2 after the writing of the signal voltage Vsig2 (at the time of light emitting operation) becomes smaller. Concretely, for example, the gate-source voltage Vgs(y) when the gray-scale interpolation voltage Vsig1 is set to the voltage y is smaller than the gate-source voltage Vgs(y−3) when the gray-scale interpolation voltage Vsig1 is set to the voltage (y−3).

Figure 7:
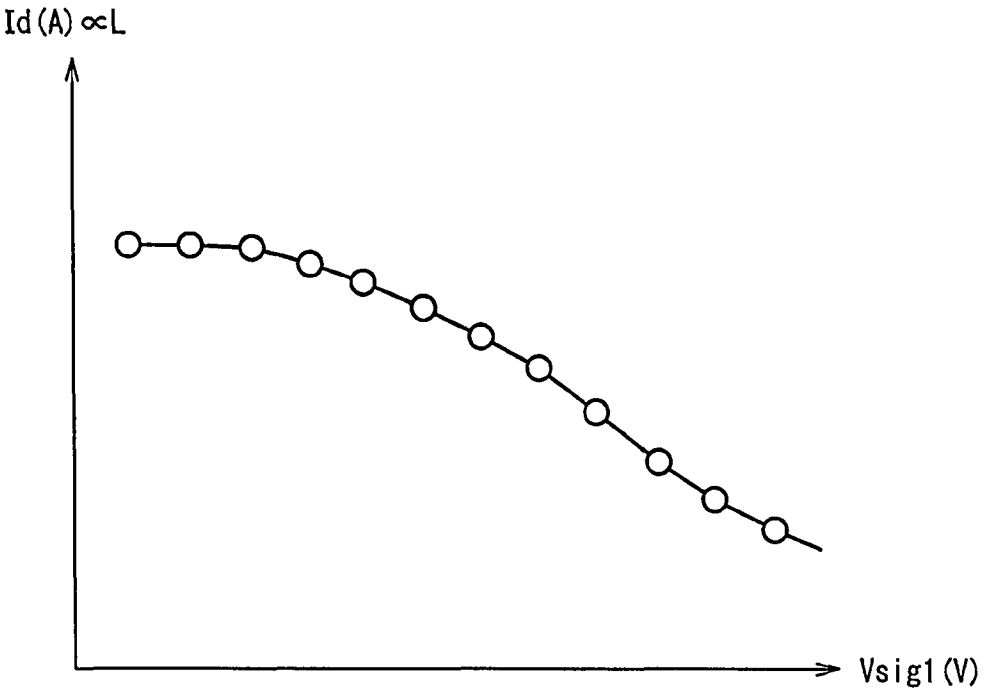
FIG. 7 is a characteristic diagram illustrating an example of the relation between the gray-scale interpolation voltage and current flowing in the drive transistor.

For example, as illustrated in FIG. 7, as the magnitude of the gray-scale interpolation voltage Vsig1 rises, the gate-source voltage Vgs of the drive transistor Tr2 in the light emitting operation decreases. As a result, the current Id flowing in the drive transistor Tr2 decreases. In proportion to the decrease in the current Id, the light emission luminance L of the organic EL element 12 also becomes lower.

Figure 8A:
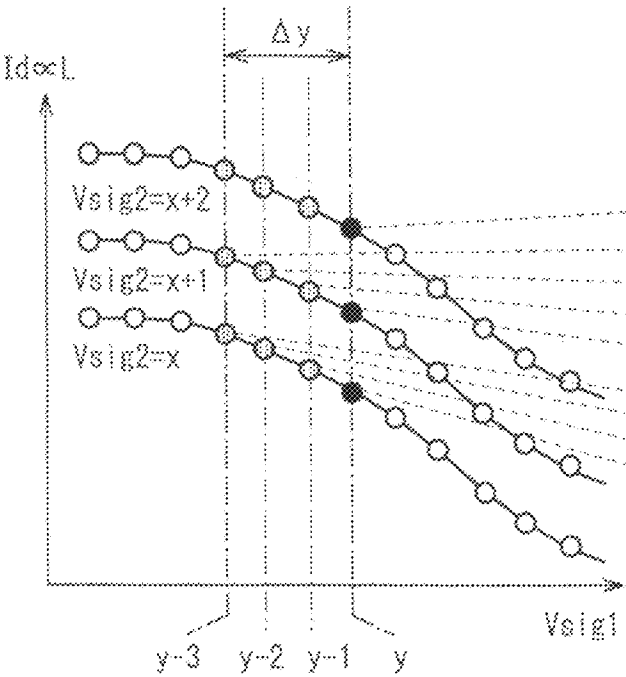
FIGS. 8A and 8B are characteristic diagrams illustrating an example of the relations between the gray-scale interpolation voltage, signal voltage, and current flowing in the drive transistor (light emission luminance of the organic EL element).
Figure 8B:
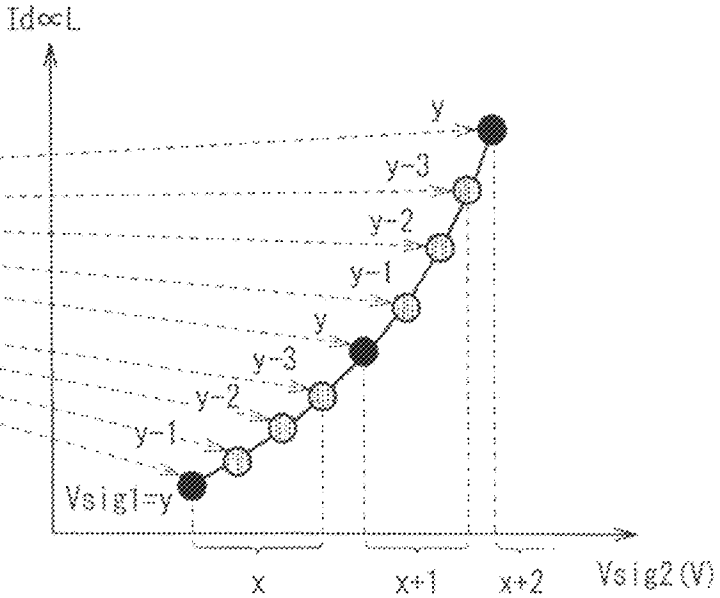

Using the above, for example, as illustrated in FIGS. 8A and 8B, the signal line drive circuit 24 selectively assigns the voltage y and the like (FIG. 8A) corresponding to four gray-scale values provided by the gray-scale interpolation voltage Vsig1 for each of the voltage x and the like (FIG. 8B) corresponding to gray-scale values which are provided by the signal voltage Vsig2. By the operation, the gray-scale interpolation as illustrated in FIGS. 5B and 8B is realized. A voltage range Ay in FIG. 8A includes gray-scale intervals of four gray-scale values provided by the gray-scale interpolation voltage Vsig1.

As described above, in the embodiment, at the time of display drive on the plurality of pixels 11 in the display panel 10, the drive circuit 20 (signal line drive circuit 24) varies the magnitude of each of the gray-scale interpolation voltage Vsig1 and the signal voltage Vsig2 according to the gray-scale value of the video signal 20A, thereby performing the gray-scale interpolation on the light emission luminance L for each of the organic EL elements 12. Therefore, expression of the gray-scale values of the number larger than the number of gray-scale values which is originally provided by the video signal 20A is realized. Therefore, while simplifying (without complicating) the configuration of the drive circuit 20 (signal line drive circuit 24), higher-definition gray-scale expression is realized. In other words, for example, even in the case of using a data drier (signal line drive circuit 24) capable of outputting the video signal 20A of M bits (M: integer), gray-scale expression of N bits (N: integer, N>M) is expressed, and reduction in the cost of the drive circuit 20 is realized. Consequently, the display device 1 of the embodiment realizes higher picture quality while reducing the cost (realizes both lower cost and higher picture quality).

MODULE AND APPLICATION EXAMPLES

Referring to FIGS. 9 to 14, application examples of the display device 1 described in the foregoing embodiment will be described below. The display device 1 of the embodiment can be applied to an electronic unit in all of fields such as a television apparatus, a digital camera, a notebook-sized personal computer, a portable terminal device such as a cellular phone, a video camera, or the like. In other words, the display device 1 is applicable to electronic units in all of fields, which displays a video signal input from the outside or a video signal generated on the inside as an image or a video image.

Module

Figure 9:
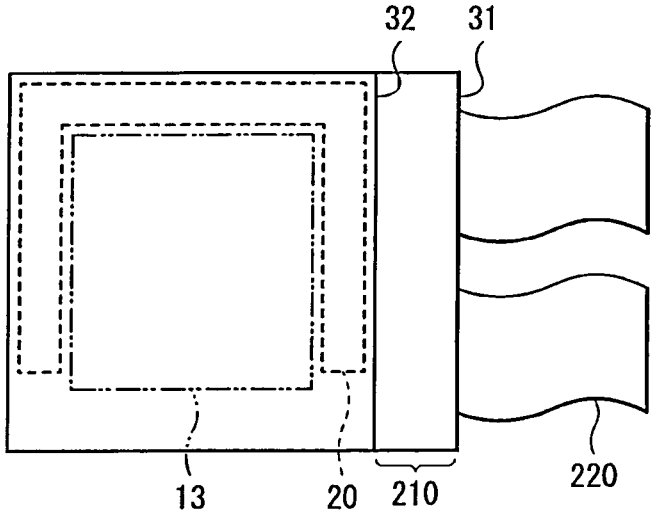
FIG. 9 is a plan view illustrating a schematic configuration of a module including the display device of the embodiment.

The display device 1 is assembled as, for example, a module as illustrated in FIG. 9, in various electronic units such as application examples 1 to 5 which will be described later. The module is obtained by, for example, providing a region 210 exposed from a sealing substrate 32 in one side of a substrate 31 and forming external connection terminals (not illustrated) by extending wires of the drive circuit 20 in the exposed region 210. The external connection terminals may be provided with flexible printed circuits (FPCs) 220 for inputting/outputting signals.

Application Example 1

Figure 10:
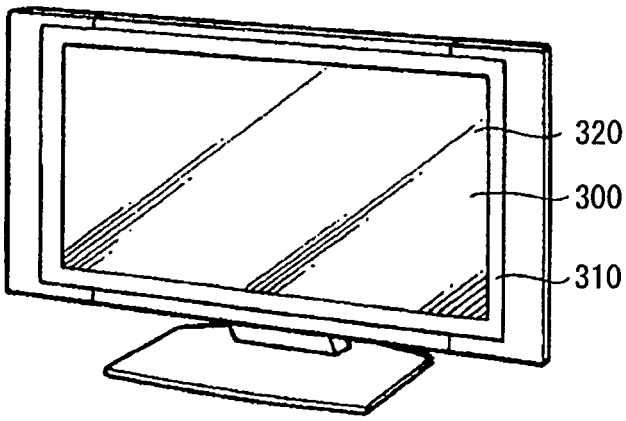
FIG. 10 is a perspective view illustrating the appearance of application example 1 of the display device of the embodiment.

FIG. 10 illustrates the appearance of a television apparatus to which the display device 1 is applied. The television apparatus has, for example, a video display screen unit 300 including a front panel 310 and a filter glass 320. The video display screen unit 300 is constructed by the display device 1.

Application Example 2

Figure 11A:
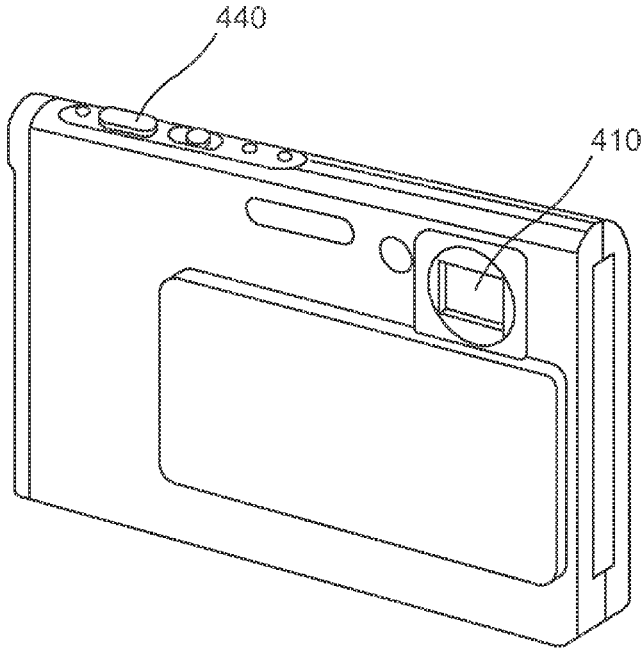
FIG. 11A is a perspective view illustrating the appearance viewed from the front side of application example 2.
Figure 11B:
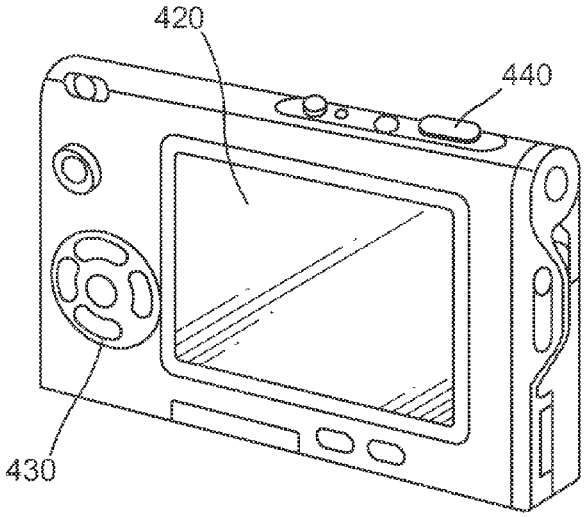
FIG. 11B is a perspective view illustrating the appearance viewed from the back side.

FIGS. 11A and 11B illustrate the appearance of a digital camera to which the display device 1 is applied. The digital camera has, for example, a light emitting unit 410 for flash, a display section 420, a menu switch 430, and a shutter button 440. The display section 420 is constructed by the display device 1.

Application Example 3

Figure 12:
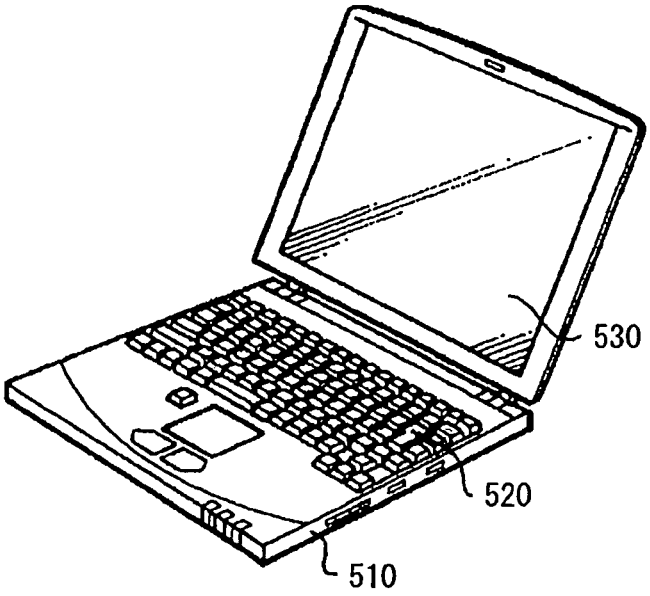
FIG. 12 is a perspective view illustrating the appearance of application example 3.

FIG. 12 illustrates the appearance of a notebook-sized personal computer to which the display device 1 is applied. The notebook-sized personal computer has, for example, a body 510, a keyboard 520 for operation of inputting characters and the like, and a display section 530 for displaying an image. The display section 530 is constructed by the display device 1.

Application Example 4

Figure 13:
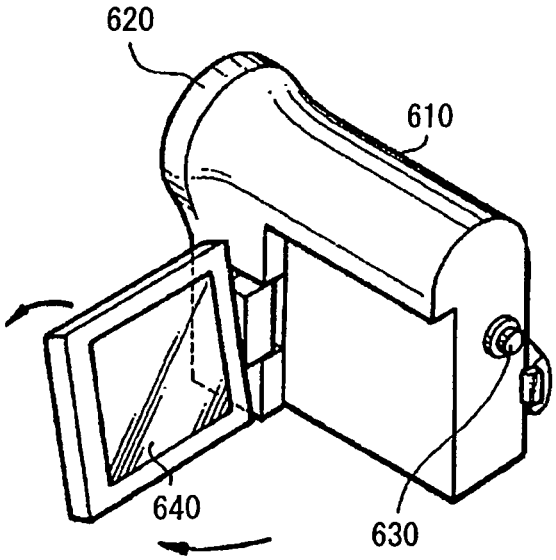
FIG. 13 is a perspective view illustrating the appearance of application example 4.
Figures 14A, 14B, 14C, 14D, 14E, 14F, 14G:
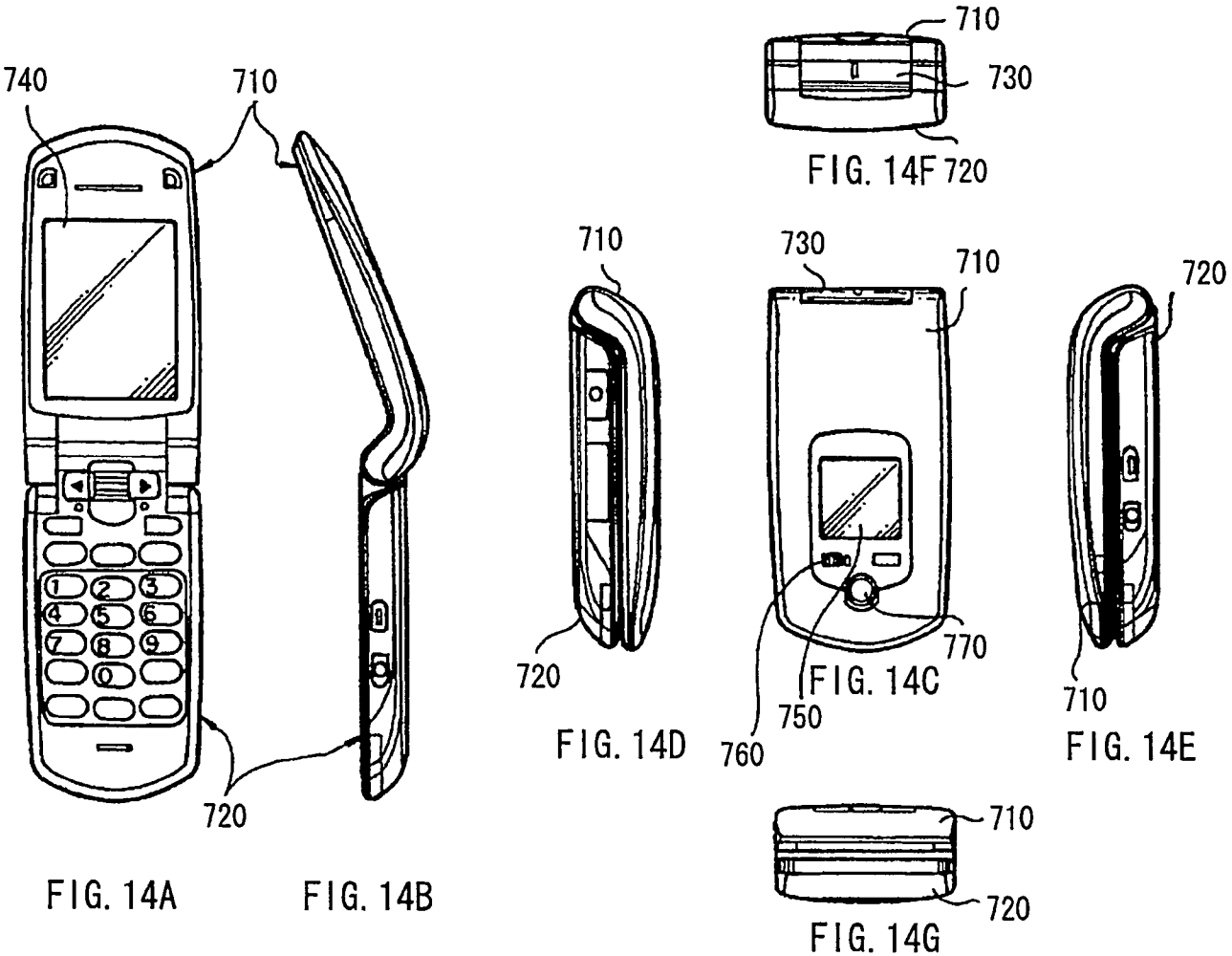
FIG. 14A is a front view in an open state of application example 5.
FIG. 14B is a side view in the open state.
FIG. 14C is a front view in a close state.
FIG. 14D is a left side view.
FIG. 14E is a right side view.
FIG. 14F is a top view.
FIG. 14G is a bottom view.

FIG. 13 illustrates the appearance of a video camera to which the display device 1 is applied. The video camera has, for example, a body 610, a lens 620 for capturing an object, provided in the front face of the body 610, a shooting start/stop switch 630, and a display section 640. The display section 640 is constructed by the display device 1.

Application Example 5

FIGS. 14A to 14G illustrate the appearance of a cellular phone to which the display device 1 is applied. The cellular phone is constructed by, for example, coupling an upper casing 710 and a lower casing 720 by a coupling part (hinge) 730 and has a display 740, a sub-display 750, a picture light 760, and a camera 770. The display 740 or the sub-display 750 is constructed by the display device 1.

Modifications

Although the present invention has been described above by the embodiment and the application examples, the present invention is not limited to the embodiment and the like but can be variously modified.

For example, in the foregoing embodiment and the like, the case of expressing 10-bit gray-scale in the light emission luminance L by interpolating the 8-bit gray-scale which can be provided by the video signal 20A with two bits by the gray-scale interpolation has been mainly described. However, the invention is not limited to the case. In other words, by using the gray-scale interpolation described in the foregoing embodiment and the like, for example, the 6-bit gray-scale is interpolated with four bits to realize the 10-bit gray-scale expression, and the 10-bit gray-scale is interpolated with two bits to realize the 12-bit gray-scale expression. In the case of interpolating a video signal which is originally set to the M-bit gray-scale with N bits, it is sufficient to make the gray-scale interpolation voltage Vsig1 change in $2^N$ values.

Although the case where the display device 1 is of the active matrix type has been described in the foregoing embodiment and the like, the configuration of the pixel circuit 14 for active matrix driving is not limited to that described in the foregoing embodiment and the like. Specifically, a capacitor, a transistor, or the like may be added to the pixel circuit 14 as necessary. In this case, according to a change in the pixel circuit 14, a necessary drive circuit may be provided in addition to the scan line drive circuit 23, the signal line drive circuit 24, and the power supply line drive circuit 25.

Further, in the embodiment and the like, although the case that the driving operations of the scan line drive circuit 23, the signal line drive circuit 24, and the power supply line drive circuit 25 are controlled by the timing generating circuit 22 has been described, another circuit may control the driving operations. The scan line drive circuit 23, the signal line drive circuit 24, and the power supply line drive circuit 25 may be controlled by hardware (circuit) or software (program).

In addition, although the case where the pixel circuit 14 has the circuit configuration of so-called "2Tr1C" has been described in the foregoing embodiment and the like, the circuit configuration of the pixel circuit 14 is not limited to 2Tr1C. In other words, as long as a circuit configuration that a transistor is connected in series to the organic EL element 12 is included, the pixel circuit 14 may have a circuit configuration other than "2Tr1C".

Although the case where the write transistor Tr1 and the drive transistor Tr2 are n-channel transistors (for example, TFTs of an n-channel MOS type) has been described in the foregoing embodiment and the like, the invention is not limited to the case. Specifically, each of the write transistor Tr1 and the drive transistor Tr2 may be a p-channel transistor (for example, a TFT of the p-channel MOS type). In this case, it is preferable to connect the source or drain of the drive transistor Tr2, which is not connected to the power supply line DSL, and the other end of the retention capacitor Cs to the cathode of the organic EL element 12, and connect the anode of the organic EL element 12 to the ground line GND or the like.

The present application contains subject matter related to that disclosed in Japanese Priority Patent Application JP 2009-258314 filed in the Japan Patent Office on Nov. 11, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a display section including a plurality of pixels, respective ones of the plurality of pixels having a light emitting element and a pixel circuit; and a drive circuit configured to perform display drive on the plurality of pixels through selecting respective ones of the plurality of pixels to write a first signal voltage and a second signal voltage in this order into the selected pixel, the first and second signal voltages being provided based on a video signal, wherein the drive circuit is further configured to vary a magnitude of each of the first and second signal voltages in accordance with a gray-scale value of the video signal, thereby performing gray-scale interpolation on a light emission luminance level for respective ones of the light emitting elements, wherein the drive circuit is configured to write a fixed third signal voltage into the selected pixel at a timing between writing the first signal voltage and the second signal voltage, the third signal voltage being lower in value than the first signal voltage and the second signal voltage.

2. The display device according to claim 1, wherein the drive circuit is configured to perform the gray-scale interpolation through setting the second signal voltage to a fundamental gray-scale voltage corresponding to one of a plurality of gray-scale values which are originally provided by the video signal, and through adjusting the first signal voltage into one of a plurality of interpolation gray-scale voltages.

3. The display device according to claim 1, wherein the display section includes a plurality of scan lines, a plurality of signal lines, and a plurality of power supply lines.

4. The display device according to claim 3, wherein the drive circuit comprises:

a scan line drive circuit configured to select a row of pixels from the plurality of pixels in succession, through applying a selection pulse to each of the plurality of scan lines in succession;

a signal line drive circuit configured to write a video signal into each pixel in the row of pixels selected by the scan line drive circuit, through applying the first and second signal voltages in this order to each of the plurality of signal lines; and a power supply line drive circuit configured to control light emitting operation and light-off operation of each of the light emitting elements, through applying a control pulse to each of the plurality of power supply lines in succession.

5. The display device according to claim 3, wherein the light emitting element includes an anode and a cathode, and the pixel circuit includes first and second transistors each having a gate, a source and a drain and includes a retention capacitor, the gate of the first transistor being connected to the scan line, one of the drain and the source in the first transistor being connected to the signal line, whereas the other one thereof being connected to both the gate of the second transistor and one end of the retention capacitor, one of the drain and the source in the second transistor being connected to the power supply line, whereas the other one thereof being connected to both the other end of the retention capacitor and the anode of the light emitting element, and the cathode of the light emitting element being set to a fixed potential.

6. The display device according to claim 1, wherein the drive circuit is configured to perform mobility correction a plurality of times within a single light-off period.

7. A method of driving a display device, comprising steps of:

performing display drive on a plurality of pixels in a display section, respective ones of the plurality of pixels having a light emitting element and a pixel circuit through selecting respective ones of the plurality of pixels to write a first signal voltage and a second signal voltage in this order into the selected pixel, the first and second signal voltages being provided based on a video signal, at the time of the display drive, varying magnitude of each of the first and second signal voltages in accordance with a gray-scale value of the video signal, thereby performing gray-scale interpolation on a light emission luminance level for respective ones of the light emitting elements, and performing the gray-scale interpolation through setting the second signal voltage to a fundamental gray-scale voltage corresponding to one of a plurality of gray-scale values which are originally provided by the video signal, and through adjusting the first signal voltage into one of a plurality of interpolation gray-scale voltages.

8. The method according to claim 7, further comprising performing mobility correction a plurality of times within a single light-off period.

9. An electronic unit having a display device, the display device comprising:

a display section including a plurality of pixels, respective ones of the plurality of pixels having a light emitting element and a pixel circuit; and a drive circuit configured to perform display drive on the plurality of pixels through selecting respective ones of the plurality of pixels to write a first signal voltage and a second signal voltage in this order into the selected pixel, the first and second signal voltages being provided based on a video signal, wherein the drive circuit is further configured to vary a magnitude of each of the first and second signal voltages in accordance with a gray-scale value of the video signal, thereby performing gray-scale interpolation on a light emission luminance level for respective ones of the light emitting elements, wherein the drive circuit is configured to perform the gray-scale interpolation through setting the second signal voltage to a fundamental gray-scale voltage corresponding to one of a plurality of gray-scale values which are originally provided by the video signal, and through adjusting the first signal voltage into one of a plurality of interpolation gray-scale voltages.

10. The electronic unit according to claim 9, wherein the drive circuit is configured to perform mobility correction a plurality of times within a single light-off period.

11. A method of driving a display device, comprising steps of:

performing display drive on a plurality of pixels in a display section, respective ones of the plurality of pixels having a light emitting element and a pixel circuit through selecting respective ones of the plurality of pixels to write a first signal voltage and a second signal voltage in this order into the selected pixel, the first and second signal voltages being provided based on a video signal, at the time of the display drive, varying magnitude of each of the first and second signal voltages in accordance with a gray-scale value of the video signal, thereby performing gray-scale interpolation on a light emission luminance level for respective ones of the light emitting elements, and writing a fixed third signal voltage into the selected pixel at a timing between writing the first signal voltage and the second signal voltage, the third signal voltage being lower in value than the first signal voltage and the second signal voltage.

12. An electronic unit having a display device, the display device comprising:

a display section including a plurality of pixels, respective ones of the plurality of pixels having a light emitting element and a pixel circuit; and a drive circuit configured to perform display drive on the plurality of pixels through selecting respective ones of the plurality of pixels to write a first signal voltage and a second signal voltage in this order into the selected pixel, the first and second signal voltages being provided based on a video signal, wherein the drive circuit is further configured to vary a magnitude of each of the first and second signal voltages in accordance with a gray-scale value of the video signal, thereby performing gray-scale interpolation on a light emission luminance level for respective ones of the light emitting elements, wherein the drive circuit is configured to write a fixed third signal voltage into the selected pixel at a timing between writing the first signal voltage and the second signal voltage, the third signal voltage being lower in value than the first signal voltage and the second signal voltage.

* * * * *